US010751857B2

(12) United States Patent
Heinsohn

(10) Patent No.: US 10,751,857 B2
(45) Date of Patent: Aug. 25, 2020

(54) PLIERS

(71) Applicant: KNIPEX-Werk C. Gustav Putsch KG, Wuppertal (DE)

(72) Inventor: Andreas Heinsohn, Wuppertal (DE)

(73) Assignee: KNIPEX-Werk C. Gustav Putsch KG, Wuppertal (DE)

( * ) Notice: Subject to any disclaimer, the term of this patent is extended or adjusted under 35 U.S.C. 154(b) by 226 days.

(21) Appl. No.: 16/073,822

(22) PCT Filed: Feb. 1, 2017

(86) PCT No.: PCT/EP2017/052100

§ 371 (c)(1),
(2) Date: Jul. 30, 2018

(87) PCT Pub. No.: WO2017/134074

PCT Pub. Date: Aug. 10, 2017

(65) Prior Publication Data

US 2019/0039214 A1 Feb. 7, 2019

(30) Foreign Application Priority Data

Feb. 4, 2016 (DE) ..... 10 2016 101 927

(51) Int. Cl.
*B25B 7/08* (2006.01)
*B25B 7/06* (2006.01)
*B25B 7/22* (2006.01)

(52) U.S. Cl.
CPC ..... *B25B 7/08* (2013.01); *B25B 7/06* (2013.01); *B25B 7/22* (2013.01)

(58) Field of Classification Search
CPC ..... B25B 7/06; B25B 7/08; B25B 7/22
See application file for complete search history.

(56) References Cited

U.S. PATENT DOCUMENTS 2,939,215 A * 6/1960 Putsch ..... B25B 7/08 30/266
3,404,457 A * 10/1968 Swanstrom, Sr. ..... B25B 7/06 30/267
3,602,074 A * 8/1971 Smith ..... B25B 7/08 81/416

(Continued)

OTHER PUBLICATIONS

International Search Report of PCT/EP2017/052100, dated Apr. 10, 2017.

*Primary Examiner* — David B. Thomas
(74) *Attorney, Agent, or Firm* — Collard & Roe, P.C.

(57) ABSTRACT

A pair of pliers having two pliers legs that are arranged in a crossing manner, wherein a fixed joint is formed, having a joint pin. The joint pin has a first conical portion that widens towards the outer side, wherein, the pliers leg is assigned a second conical portion which bears on the first conical portion and transitions into a first mouth portion that leads into the outer side of the pliers leg. The joint pin has a second mouth portion which, starting from the outer side of the pliers leg and perpendicularly to a joint axis, overlaps the first mouth portion. The first and second mouth portion, bound a circular clearance between one another, the radial dimension of the clearance corresponding to 0.05 to 0.15 times the radial dimension, measured from the joint axis of the joint pin in the region of the second mouth portion.

10 Claims, 7 Drawing Sheets

(56) References Cited

U.S. PATENT DOCUMENTS

| | | | | |
|---|---|---|---|---|
| 4,882,959 | A * | 11/1989 | Sakai | B25B 7/06<br>81/416 |
| 7,389,715 | B1 | 6/2008 | Lin | |
| 2003/0070300 | A1 | 4/2003 | Huang | |
| 2011/0005086 | A1 | 1/2011 | Putsch | |

* cited by examiner

PLIERS

CROSS REFERENCE TO RELATED APPLICATIONS

This application is the National Stage of PCT/EP2017/052100 filed on Feb. 1, 2017, which claims priority under 35 U.S.C. § 119 of German Application No. 10 2016 101 927.5 filed on Feb. 4, 2016, the disclosures of which are incorporated by reference. The international application under PCT article 21(2) was not published in English.

TECHNICAL FIELD

The invention pertains to a pair of pliers with two pliers legs that are arranged in a crossing manner, wherein a fixed joint with a joint pin is formed, wherein the joint pin has a first conical portion, which is in any case assigned to an outer side of a pliers leg and widens toward the outer side, and wherein the pliers leg is furthermore assigned a second conical portion, which bears on the first conical portion and transforms into a first mouth portion leading into the outer side of the pliers leg.

PRIOR ART

Pairs of pliers of the type in question are known. The pliers legs arranged in a crossing manner may form, e.g., a lay-on joint or a lap joint in the crossing region. This joint is fixed, i.e. the joint axis is not variable with respect to its positioning relative to both pliers legs.

In connection with such pairs of pliers, it is furthermore known to use joint pins in the form of an insertion rivet. In this case, the joint pin respectively penetrates the pliers legs in the region of a joint lug.

In order to minimize a notch effect between the joint pin and the joint lug in the pliers leg, particularly due to the potentially high forces acting upon the joint during the utilization of the pair of pliers, it is furthermore known to provide the joint pin with a first conical portion that widens toward the outer side of the assigned pliers leg. In this context, it is furthermore known to conically widen the conical portion as far as into the broad face of the pliers leg formed by the outer side of the pliers leg. In the known prior art, this first conical portion of the joint pin bears on a second conical portion formed in the region of the joint lug of the assigned pliers leg.

In other known designs, the second conical portion in the region of the pliers leg transforms into a first mouth portion in the direction of the outer side of the pliers leg in accordance with the second conical portion in the region of the joint lug. This mouth portion may have a maximum diameter that corresponds to the widened cone diameter. In such designs, the second conical portion in the pliers leg may accordingly be realized such that it does not radially widen further as far as into the outer surface of the pliers leg. In fact, the uniform conical extent in the direction of the outer side can be interrupted due to the formation of the first mouth portion.

SUMMARY OF THE INVENTION

In light of the known prior art, the invention aims to solve the technical problem of additionally improving pairs of pliers of the type in question with respect to their function.

According to a first inventive idea, a potential solution to this problem is achieved with a pair of pliers, in which the joint pin has a second mouth portion that overlaps the first mouth portion starting from the outer side of the pliers leg and perpendicular to a (geometric) joint axis, wherein the first and the second mouth portion bound a toroidal clearance between one another in a radially encircling manner, and wherein the radial dimension of said clearance corresponds to 0.05-times to 0.15-times the radial dimension of the joint pin in the region of the second mouth portion, which is measured starting from the joint axis.

Accordingly, the conical radial widening, particularly a uniform conical widening of the joint pin, may also be interrupted due to the formation of a terminal second mouth portion, which extends starting from the first conical portion as far as the assigned outer surface of the pliers leg. The second mouth portion can preferably also have the maximum radial dimension of the first conical portion (starting from the geometric joint axis).

Starting from the joint axis, the second mouth portion of the joint pin is furthermore realized such that it overlaps the first mouth portion—viewed perpendicular to the extent of the joint axis—in the region of the joint lug in the assigned pliers leg. The radial overlap of the second mouth portion with the first mouth portion or vise versa may be complete or only partial, e.g. by half the extent viewed in the direction of the joint axis or, e.g., by one third or one quarter.

In comparison with a design, in which one or both conical portions are realized uniformly and continuously as far as into the mouth region, a diameter reduction of the joint lug, as well as of the joint pin in the mouth region of the joint lug, can preferably also be realized adjacent to the conical portions due to the design of the two mouth portions. At an identical, sufficient stability of the joint pin and the joint pin connection as a whole, this can lead to a narrower structural shape of the pliers legs viewed transversely and therefore radially to the geometric joint axis. The notch effect is furthermore kept low due to the additionally provided first and second conical portions.

This can be additionally promoted with the preferably provided toroidal clearance. It is also preferred that the second mouth portion on the joint pin side does is not directly bear on the first mouth portion on the pliers leg side. In fact, the surface areas of the mouth portions, which point toward one another in the radial direction, are in a preferred embodiment spaced apart from one another with respect to encircling the joint axis. The spacing dimension in the clearance may be chosen identically over the circumference. The radial dimension of the toroidal clearance can preferably be chosen such that a potential capillary transport of a lubricant supply provided between the surface areas of the joint pin and the respective joint lug is thereby interrupted axially outward. If applicable, a lubricant supply may also accumulate in the toroidal clearance and then be drawn axially inward again due to the capillary effect.

In addition, the radial dimension of the toroidal clearance is preferably chosen so small that no dirt accumulation, e.g. in the form of chips or the like, which could negatively affect the mobility of the pair of pliers, can take place therein.

If the joint pin has in the region of the second mouth portion an exemplary maximum radial dimension of 4.5 to 5.5 mm, preferably about 4.9 mm, a radial dimension of the toroidal clearance may lie between 0.35 and 0.55 mm, preferably at about 0.45 mm.

Other characteristics of the invention are elucidated below, as well as in the description of the figures, frequently in their preferred correlation with the object of claim 1 or with characteristics of other claims. However, they may also be significant in correlation with only individual characteristics of claim 1 or the respective other claim or independently.

In another embodiment, the first and/or second mouth portion may include an acute angle with the joint axis in a cross section, in which the joint axis is illustrated in the form of a line. Such an acute angle may lie, for example, between greater than zero and up to 20 or 30 degrees, wherein the inclination of the mouth portion wall, particularly of the joint pin, may be directed radially outward, but also radially inward, relative to the joint axis starting from the conical portion. A preferred cylindrical shape of the mouth portion is achieved at an acute angle of zero degrees.

The angle of inclination of the mouth portion relative to the joint axis is preferably smaller than the angle of inclination of the associated conical portion relative to the joint axis.

In another embodiment, it would be conceivable that a length of the second mouth portion measured in the direction of the joint axis is greater than a length of the first mouth portion measured in the direction of the joint axis. In this preferred embodiment, the second conical portion of the pliers leg therefore preferably can in the region of the joint lug extend beyond the transition from the first conical portion into the second mouth portion of the joint pin in the direction of the outer side of the pliers leg. The line in the transition from the first conical portion into the second mouth portion resulting on the joint pin in an encircling manner may bear on the second conical portion of the pliers leg.

The longitudinal dimension of the second mouth portion in the region of the joint pin, which is measured in the direction of the joint axis, can preferably correspond to 1.5-times to 2.5-times the longitudinal dimension of the first mouth portion on the pliers leg side in the same direction. This makes it possible to realize an embodiment, in which the second mouth portion is designed for (only) lying radially opposite of a partial region of the second conical portion over part of its axial length.

In another embodiment, the axial length of the second mouth portion may correspond to 0.1-times to 0.3-times the radial dimension of the joint pin in the region of the second mouth portion, which is measured starting from the joint axis. If the joint pin has in the region of the second mouth portion an exemplary radial dimension of 4.5 to 5.5 mm, preferably about 4.9 mm, a resulting axial length of the second mouth portion may lie between 1 and 1.5 mm, for example about 1.2 mm.

The axial length of the first mouth portion may also correspond to 0.05-times to 0.15-times the radial dimension of the joint pin in the region of the second mouth portion, which is measured starting from the joint axis. Based on an above-described exemplary radial dimension of the joint pin, a resulting length of the first mouth portion may lie between 3.5 and 5.5 mm, preferably about 4.5 mm.

Both mouth portions can preferably also transform into the same outer side of the assigned pliers leg or the joint pin, which extends perpendicular to the joint axis. Accordingly, it would be possible to realize an embodiment, in which the surfaces of the joint pin and the pliers leg, which extend perpendicular to the joint axis and in which surfaces of the respective mouth portions end, extend in a common plane.

The above-described embodiment may with respect to the first and second mouth portions, if applicable also in connection with the first and second conical portions, refer to only one axial end region of the joint pin and the joint lug in the pliers leg interacting therewith, but may, if applicable, also refer to both axial end regions.

In another preferred embodiment, the pair of pliers has a symmetry axis, which extends through the joint axis and on which work regions of the pliers legs can be moved toward one another. The work regions of the pliers legs may consist of jaw surfaces or cutting edges that are realized on pliers jaws formed by the pliers legs. Furthermore, such pairs of pliers are also known, e.g., in the form of pipe wrenches, side cutting nippers or center cutting nippers and, e.g., in the form of gripping pliers or even universal pliers.

A first ring wall portion is provided on the symmetry axis and assigned to the work regions. This ring wall portion at least partially surrounds the joint pin. Accordingly, the ring wall portion essentially extends transversely to the geometric joint axis. In a preferred embodiment, this first ring wall portion, which is assigned to the work regions, may have a thickness that corresponds to between half and one third of the radial dimension of the joint pin in the region of the second mouth portion. If the second mouth portion has an exemplary maximum radial dimension of 4.5 to 5.5 mm, preferably about 4.9 mm, the thickness or material thickness of the first ring wall portion viewed perpendicular to the joint axis may amount to approximately 2 to 2.5 mm.

Due to this design, the geometric rotational axis is realized relatively close to the work regions. This leads to an advantageous force effect when the pliers legs are actuated. In a pair of pliers with cutting work regions, in particular, an advantageous lever arm with respect to the cutting technology is thereby achieved.

Due to the described design of the joint pin adjacent to a conically widening region, such a narrow yet stable design of the first ring wall portion can be realized while simultaneously preserving a high stability and taking into account a minimal notch effect. In comparison with a joint pin design, in which the conical portion extends as far as into the plane of the outer side of the pliers leg and the first ring wall portion has the same thickness, the geometric joint axis is advantageously shifted with respect to the lever arm technology along the symmetry axis in the direction of the work regions of the pliers legs.

A second ring wall portion, which lies opposite of the first ring wall portion in the direction of the symmetry axis, may also have a thickness that approximately corresponds to the diameter of the joint pin in the region of the second mouth portion, e.g. a thickness corresponding to approximately 0.75-times to 2-times.

This makes it possible to realize a design, in which the second ring wall portion has a significantly greater thickness than the first ring wall portion transversely the geometric joint axis, e.g. a thickness corresponding to 2-times to 5-times the thickness of the first ring wall portion. With respect to the pliers leg portion surrounding the joint pin in the region of the penetration—viewed in the direction of the outer side of the pliers leg—the geometric joint axis is thereby shifted out of the surface center along the symmetry axis in the direction of the work regions. This shift furthermore provides an advantageous prerequisite with respect to widely opening the pliers mouth defined by the pliers jaws.

With respect to the disclosure, the ranges or value ranges or the multiple ranges indicated above and below also include all intermediate values, particularly in 1/10 increments of the respective dimension or, if applicable, also dimensionless. For example, the indication of 0.05-times to 0.15-times also includes the disclosure of 0.06-times to 0.15-times, 0.05-times to 0.14-times, 0.06-times to 0.14-times, etc., and the indication of 0.1-times to 0.3-times also includes the disclosure of 0.11-times to 0.3-times, 0.1-times to 0.20-times, 0.11-times to 0.29-times, etc. This disclosure may on the one hand serve for defining the lower and/or upper limits of a cited range, but alternatively or additionally also for disclosing one or more singular values in a respectively indicated range.

BRIEF DESCRIPTION OF THE DRAWINGS

The invention is described in greater detail below with reference to the attached drawings that merely show exemplary embodiments. A component, which is only described with reference to one of the exemplary embodiments and in another embodiment not replaced with a different component due to its specific characteristics, is therefore also described as a potentially existing component for this other exemplary embodiment. In the drawings.

DESCRIPTION OF THE EMBODIMENTS

Figure 1:
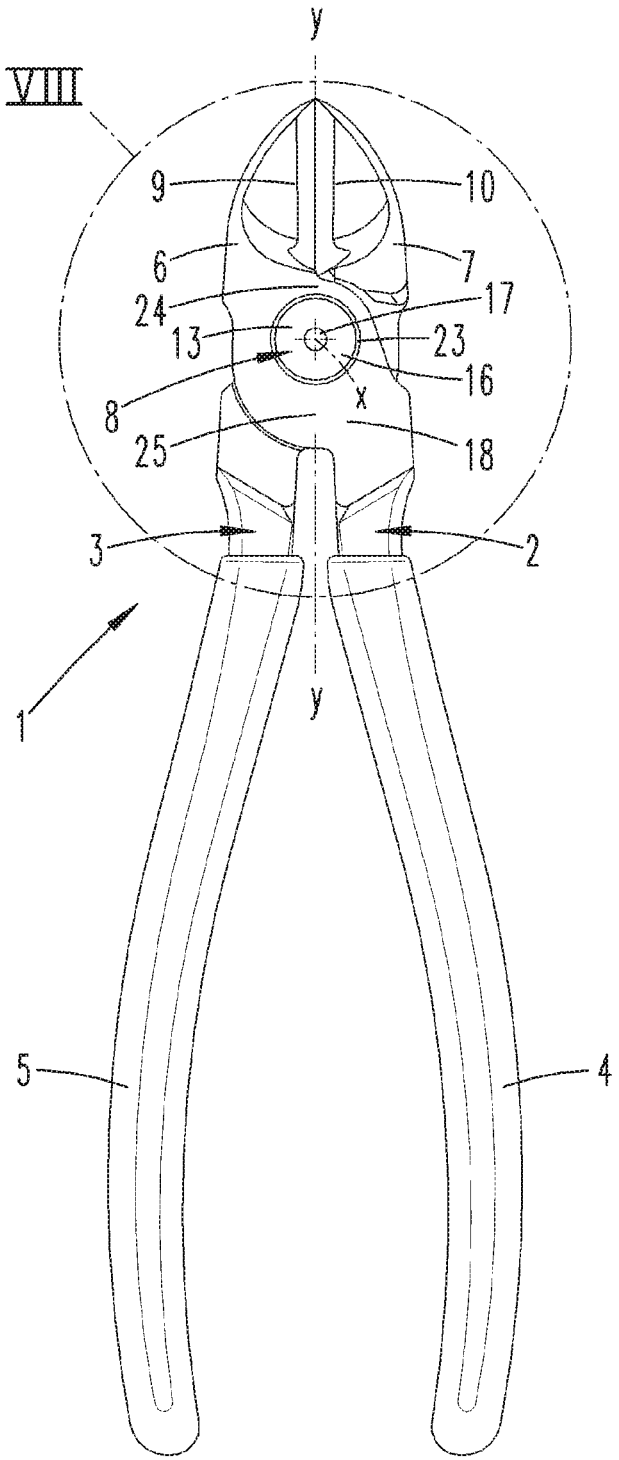
FIG. 1 shows the front view of a pair of pliers concerning a first embodiment.
Figure 2:
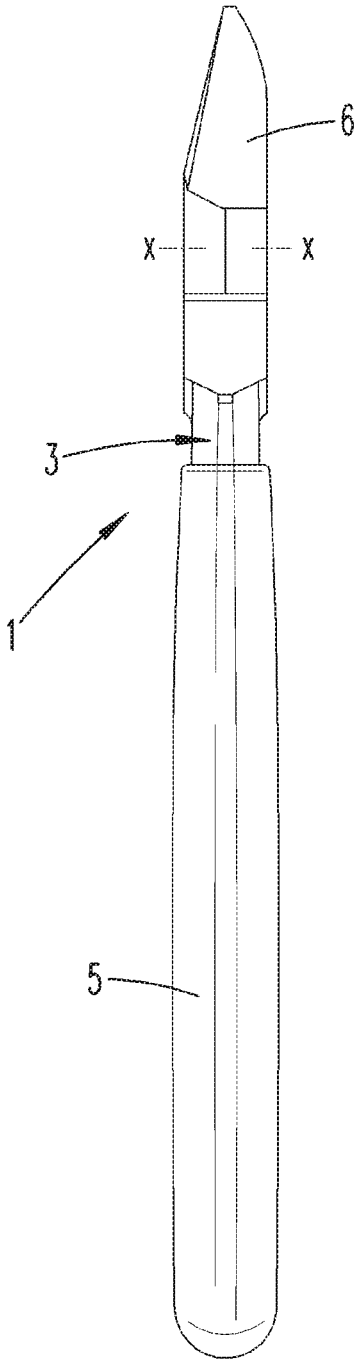
FIG. 2 shows a corresponding side view.
Figure 3:
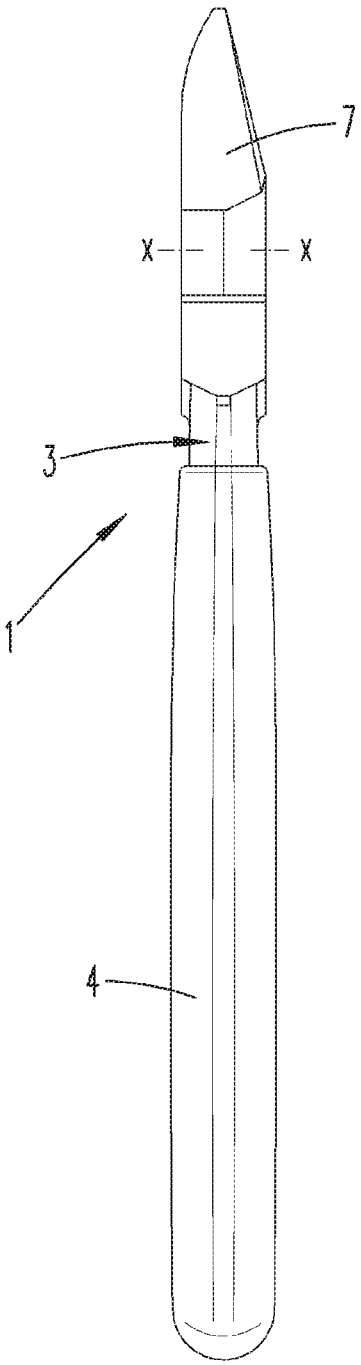
FIG. 3 shows the opposite side view.
Figure 4:
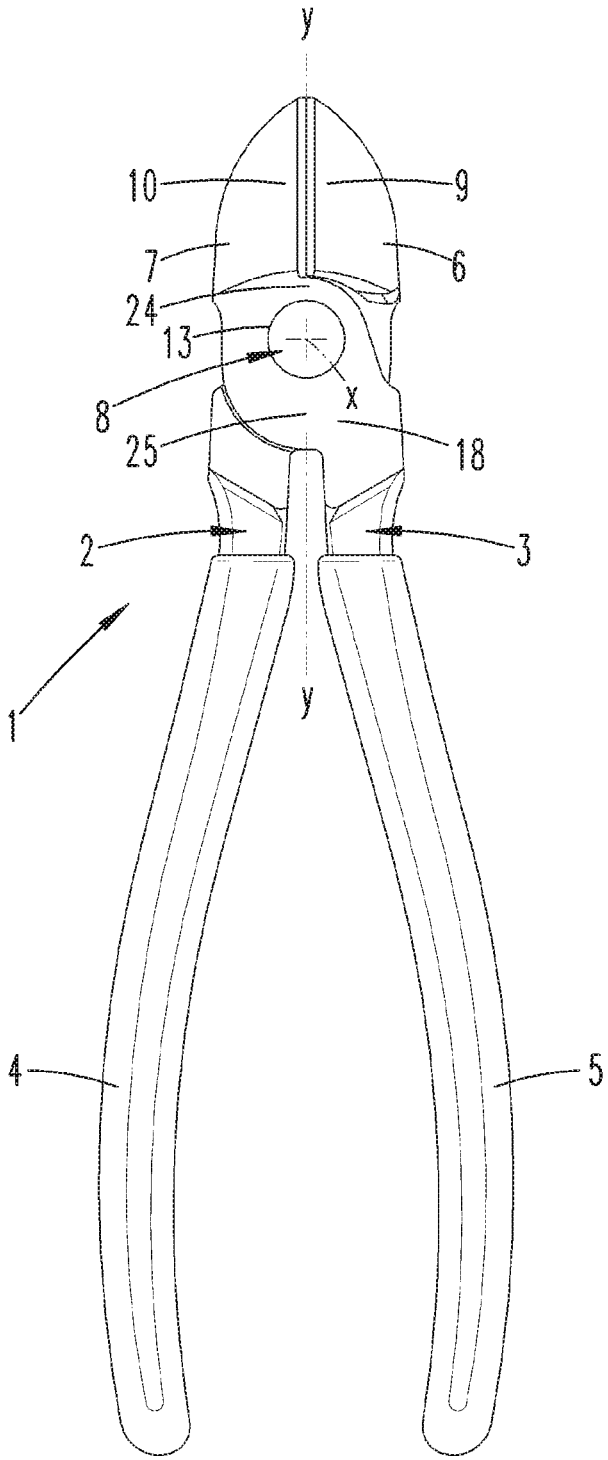
FIG. 4 shows a rear view of the pair of pliers.
Figure 5:
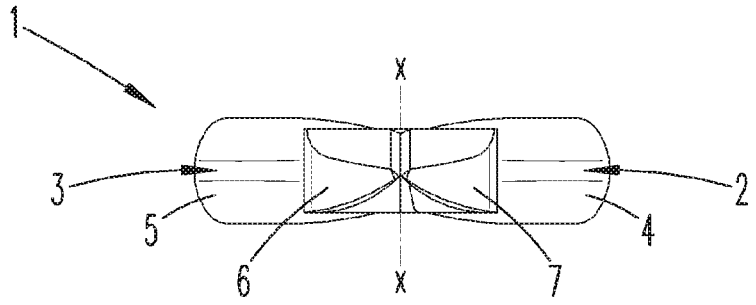
FIG. 5 shows a top view of the pair of pliers.
Figure 6:
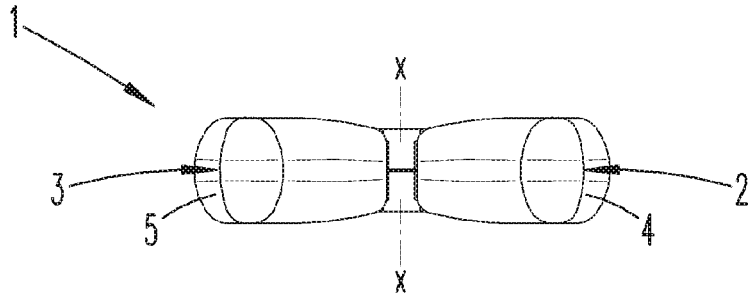
FIG. 6 shows a bottom view of the pair of pliers.
Figure 7:
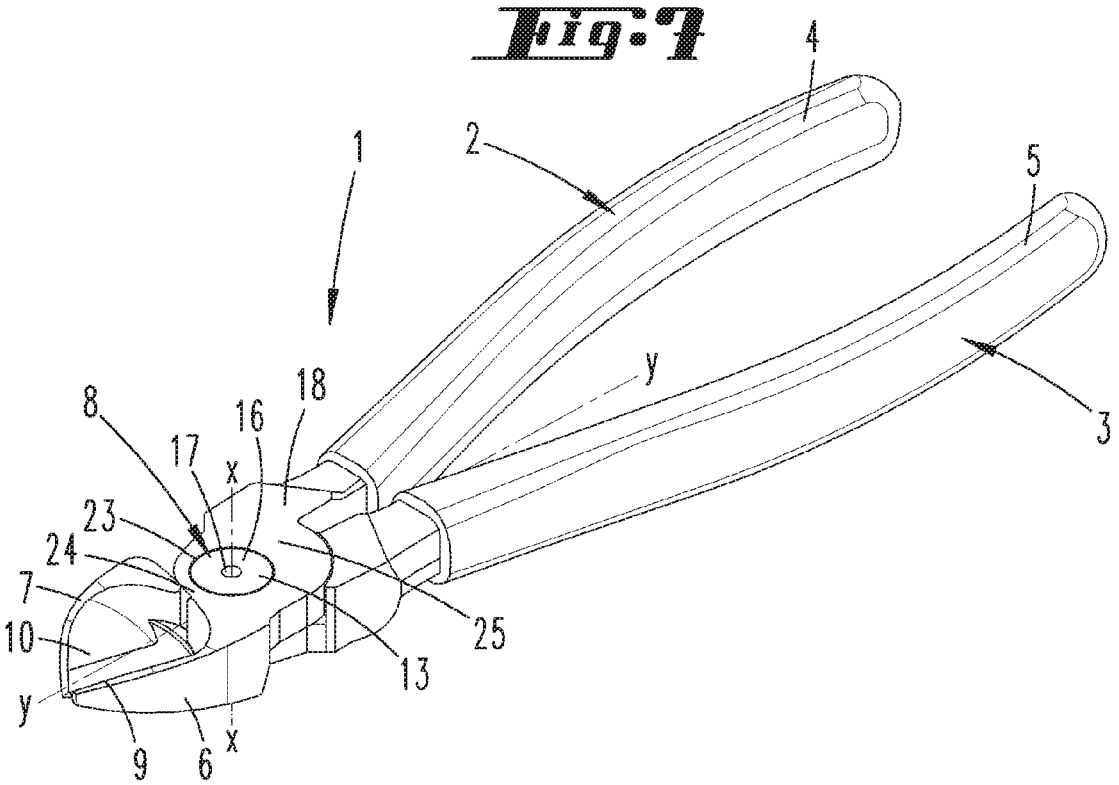
FIG. 7 shows a perspective representation of the pair of pliers.
Figure 8:
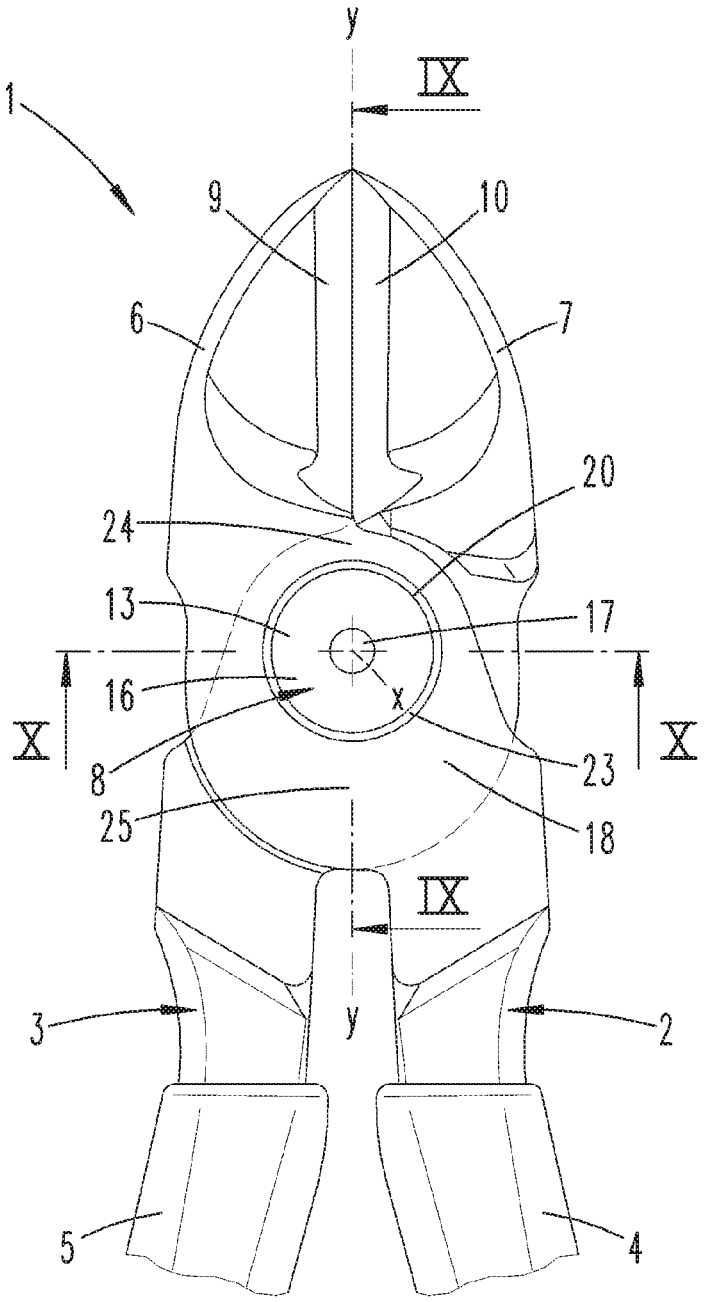
FIG. 8 shows the enlarged detail of the region VIII in FIG. 1.

A pair of pliers 1 is initially described with reference to FIG. 1. In the first embodiment illustrated in FIGS. 1-10, this pair of pliers is realized in the form of side cutting nippers. However, the embodiments described below not only concern such side cutting nippers, but rather all possible types of pliers with a fixed joint pin and therefore also a pair of pliers 1 in the form of universal pliers according to the illustration in FIG. 11.

The pair of pliers 1 comprises two pliers legs 2, 3 that are arranged in a crossing manner. In this case, each pliers leg 2, 3 forms a handle leg 4, 5 that transforms into a pliers jaw 6, 7 beyond the crossing region of the pliers legs 2, 3.

The handle leg 4 and the pliers jaw 6 form the pliers leg 2; the handle leg 5 and the pliers jaw 7 form the pliers leg 3.

In the exemplary embodiment shown, the joint (single joint) of the pair of pliers 1 is realized in the form of a lap joint, wherein the pliers legs 2, 3 have material notches in the crossing region, and wherein portions of the other pliers leg lie in said notched regions.

The fixed joint furthermore comprises a joint pin 8. This joint pin penetrates the pliers legs 2, 3 in the transition region from the respective handle leg into the pliers jaw.

A geometric joint axis x simultaneously forms the body axis of the joint pin 8 and extends perpendicular to a plane, in which the pliers legs 2, 3 move during an actuation of the pair of pliers 1.

The joint pin 8 is preferably a solid bolt rivet.

The pair of pliers 1 is furthermore realized largely symmetrical referred to a symmetry axis y, which extends through the joint axis x and on which work regions 9, 10 of the pliers legs 2, 3 can be moved toward one another. In the first exemplary embodiment of the pair of pliers 1 in the form of side cutting nippers, these work regions 9, 10 are realized in the form of cutting edges. If the pair of pliers 1 is realized in the form of universal pliers according to the illustration in FIG. 11, different work regions 9, 10 such as a cutting region, a gripping region and a terminal flat pliers region are adjacently arranged in a row along the symmetry axis y.

Figure 11:
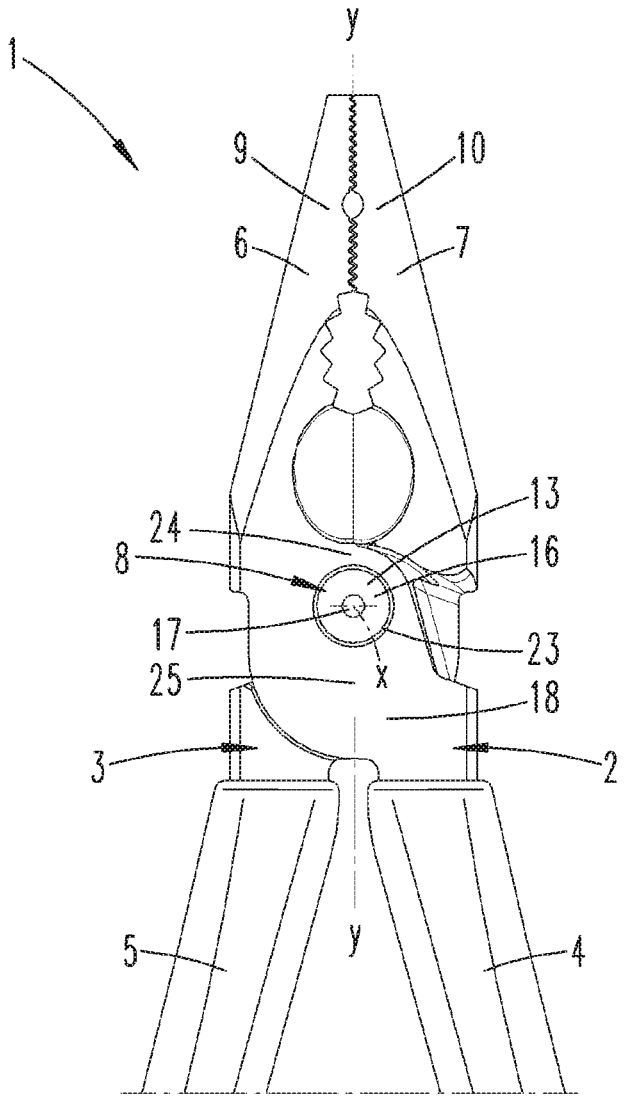
FIG. 11 shows a representation that corresponds to FIG. 8 and concerns a second embodiment of the pair of pliers.

In the closed position of the pliers mouth according to the illustrations in FIGS. 1 and 11, work regions 9, 10 in the form of cutting edges or flat jaws meet one another on the symmetry axis y.

In the crossing region of the pair of pliers, the joint pin 8 penetrates each pliers leg 2 in the region of a joint lug 11, 12 formed at this location.

The joint pin 8 is preferably realized in the form of an insertion rivet that is inserted through the joint lugs 11, 12 of the pliers legs 2, 3 in the direction of the joint axis x from one side, wherein a first end region of the rivet viewed in the inserting direction is then correspondingly deformed, for example by means of wobble riveting.

To this end, the bolt rivet essentially consists of a head part 13 and a shaft part 14. The head part 13 is accommodated in an essentially form-fitting manner in the associated joint lug 11 in the pliers leg 2 whereas the shaft part 14 extends through both pliers legs 2 and 3 in the region of the respective single joint or joint. The shaft part 14 is for the intended riveting process realized so long that a shaft portion protruding from the pliers legs 2 and 3 to be riveted to one another can be formed into a rivet depression 15 toward the head part.

The drawings respectively show a pair of pliers 1 with a joint pin 8 after the completion of the riveting process.

The head part 13 comprises a central blind bore 17 that leads into the bolt face 16 extending transversely to the joint axis x, particularly for the purpose of a convenient adjustment. This blind bore extends in the direction of the joint axis x over approximately half the axial dimension of the head part 13.

The following explanations with respect to the design of the joint pin portion and the associated joint lug refer to the head part 13 of the joint pin 8 and the joint lug 11 in the pliers leg 2. However, this described design may alternatively or additionally also be realized in the region of the opposite end of the joint pin 8 in connection with the joint lug 12 in the pliers leg 3.

The joint pin 8 has a first conical portion 19, which is assigned to the outer side 18 of the pliers leg 2 extending transversely to the joint axis x and widens toward the outer side 18, wherein said first conical portion starts at the shaft part 14 and therefore essentially defines the head part 13. This first conical portion 19 of the joint pin 8 transforms into a terminal second mouth portion 20, the bolt face 16 of which preferably extends in the plane defined by the outer side 18 of the pliers leg 2.

The joint lug 11 formed in the pliers leg 2 has a cylindrical portion, which faces the other pliers leg 3 and on which the outer wall of the shaft part 14 is supported. This cylindrical region transforms into a second conical portion 21 in the direction of the outer side 18, wherein the end of said second conical portion leads into a first mouth portion 22. This first mouth portion 22 transforms into the outer side 18 of the pliers leg 2.

The first conical portion 19 of the joint pin 18 bears on the second conical portion 21.

Figure 9:
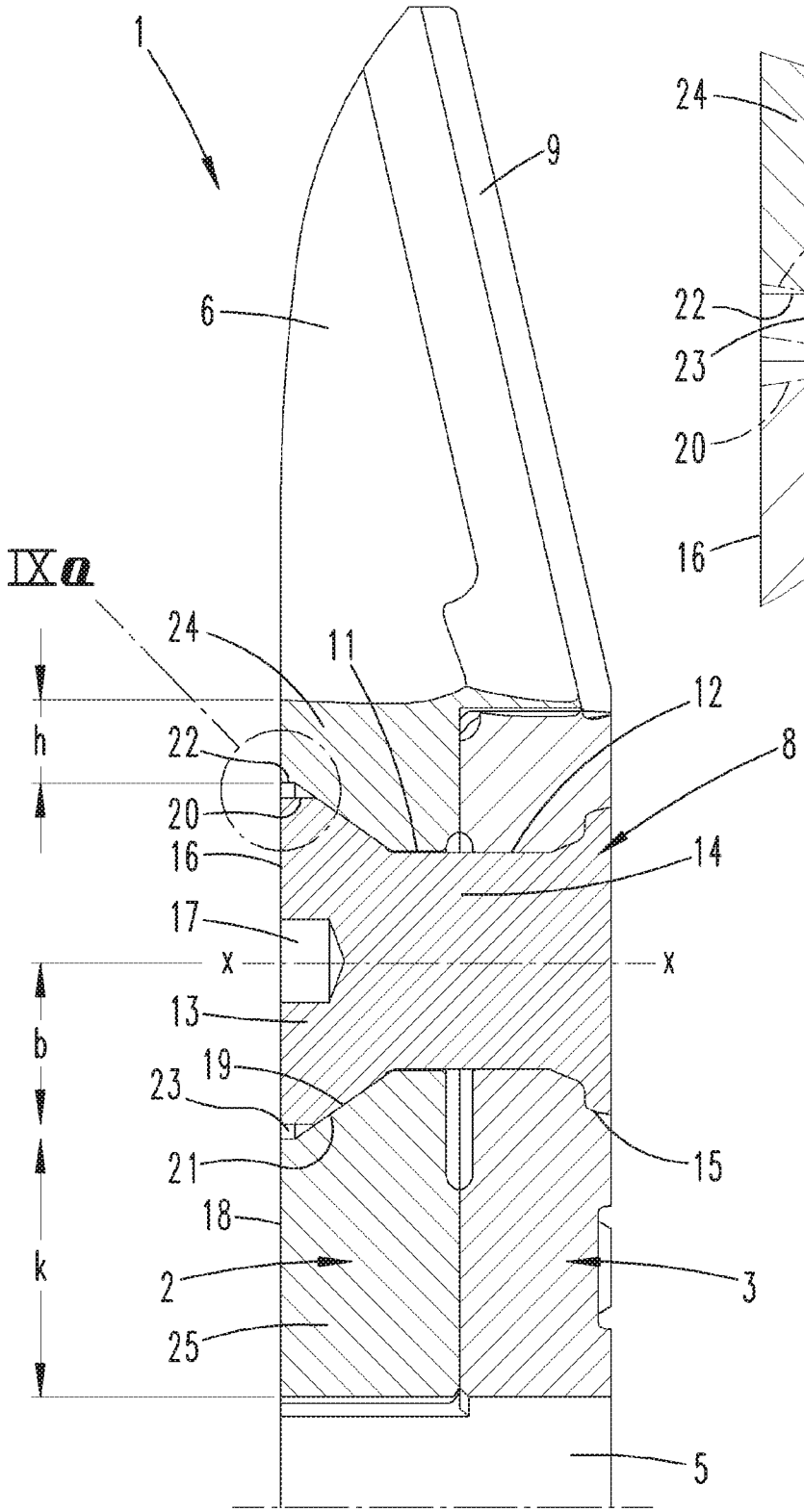
FIG. 9 shows a section along the line IX-IX in FIG. 8.
Figure 9A:
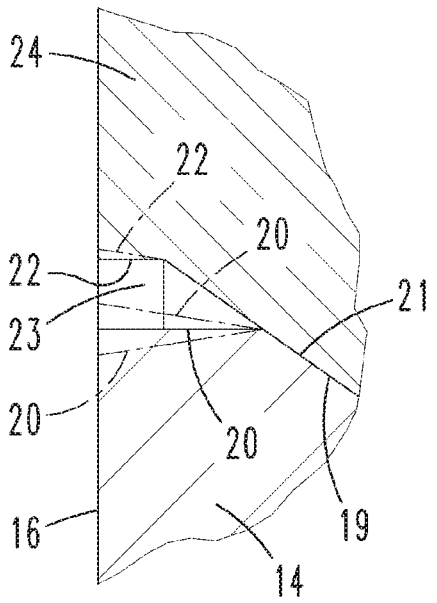
FIG. 9*a* shows the enlarged detail of the region IXa in FIG. 9.
Figure 10:
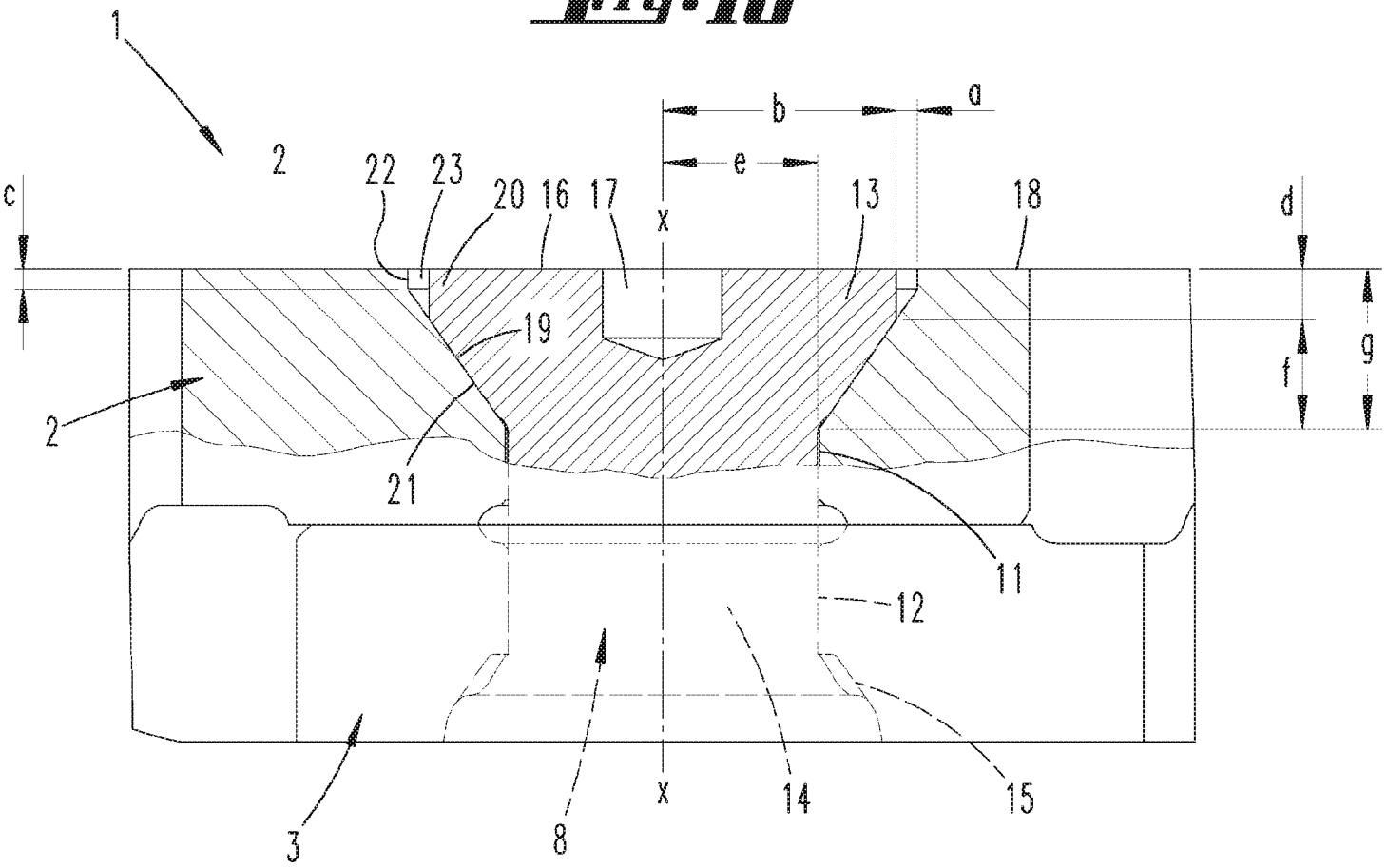
FIG. 10 shows a partial section along the line X-X in FIG. 8.

The enlarged detail in FIG. 9*a* particularly shows that a circular-cylindrical design referred to the joint axis x can be realized with respect to the mouth portions 20, 22. The encircling walls of both mouth portions 20, 22 extend parallel to the joint axis x in the cross section according to FIG. 9*a*.

Alternatively, the wall of the mouth portion 20 and/or 22 may starting from the conical portion 19, 21 include an acute angle, for example, of up to 15 degrees with the joint axis x (see dotdashed wall configuration in FIG. 9*a*), wherein the wall may with respect to the wall configuration of the second and/or first mouth portion 20, 22 be inclined radially inward or radially outward starting from the conical portion 19, 21.

The encircling surface area of the second mouth portion 20 on the pin side is spaced apart from the encircling inner surface area of the first mouth portion 22 on the leg side radially inward referred to the joint axis x. In this way, a toroidal clearance 23 encircling the joint axis x is formed, wherein said toroidal clearance is with respect to a cross section according to the illustration in FIG. 10 essentially closed on three sides and only opens toward the outer side 18.

The clearance 23 has a maximum radial dimension a, which is preferably measured in the plane of the outer side 18 and corresponds to 0.05-times to 0.15-times the radial dimension b of the joint pin 8 in the region of the second mouth portion 20, which is measured starting from the joint axis x. In the exemplary embodiment shown, the radial dimension a of the clearance 23 approximately corresponds to 0.085-times the radial dimension b in the region of the second mouth portion 20.

This furthermore means that, viewed in the direction of the joint axis x, the axial length of the second mouth portion 20 on the joint pin side is greater than the axial length of the first mouth portion 22 in the pliers leg 2 viewed in the same direction. In the exemplary embodiment according to the illustration in FIG. 10, the length c of the first mouth portion 22 on the leg side approximately corresponds to 0.4-times to 0.5-times the length d of the second mouth portion 20 on the pin side.

The length c of the first mouth portion 22 on the leg side may also correspond to 0.9-times to 1.1-times and furthermore to approximately 1-times the radial dimension a of the clearance 23.

Due to the above-described dimensions, a line encircling the joint axis x is formed in the transition region from the first conical portion 19 into the second mouth portion 20 of the joint pin 8, wherein said transition line radially overlaps the conical surface of the second conical portion 21 on the leg side. The second conical portion 21 extends beyond this transition line in the direction of the outer side 18 and ultimately transforms into the first mouth portion 22.

Accordingly, the clearance 23 furthermore has a cross-sectional design, in which a region with a constant radial dimension a is formed over the axial height of the first mouth portion 22 starting from the outer side 18 and transforms into a portion that is continuously tapered radially and axially inward. An encircling, inwardly directed interstice region of the clearance 23 is thereby formed.

The radial dimension b of the second mouth portion 20 on the pin side can preferably correspond to 1.2-times to 1.8-times and furthermore to approximately 1.5-times the radial dimension e in the region of the shaft part 14 as shown.

A resulting axial dimension f of the first conical portion 19 of the joint pin 8 may approximately correspond to 0.6-times to 0.8-times and furthermore to approximately 0.7-times the axial dimension g of the entire head part 13, which is composed of the first conical portion 19 and the second mouth portion 20.

Ring wall regions encircling the joint pin 8 are formed in the pliers legs. A first ring wall portion 24 is assigned to the work regions 9 and 10 and with respect to a cross section according to the illustration in FIG. 9 extends between the toroidal clearance 23 and the respective work regions 9 and 10.

In the exemplary embodiment shown, a thickness h measured radially to the joint axis x and along the symmetry axis y approximately corresponds to 0.5-times the radial dimension b of the second mouth portion 20 on the pin side.

The second ring wall portion 25 between the clearance 23 and the attachment regions of the handle legs 4 and 5, which lies opposite of the first ring wall portion 24 in the direction of the symmetry axis y, has a corresponding thickness k that approximately corresponds to 1.5-times the radial pin dimension b in the region of the second mouth portion 20.

The joint pin 8 is therefore shifted from the geometric center of the crossing region of the pliers legs 2 and 3 in the direction of the work regions 9, 10 along the symmetry axis y by approximately the radial dimension e in the region of the shaft part 14. In this way, an advantageous force transmission to the work regions 9 and 10 is achieved when the pair of pliers 1 is actuated, namely without affecting the joint pin-joint stability.

The preceding explanations serve for elucidating all inventions that are included in this application and respectively enhance the prior art independently with at least the following combinations of characteristics, namely:

A pair of pliers, which is characterized in that the joint pin 8 has a second mouth portion 20 that overlaps the first mouth portion 22 starting from the outer side 18 of the pliers leg 2, 3 and perpendicular to a joint axis x, wherein the first and the second mouth portion 22, 20 bound a toroidal clearance 23 between one another in a radially encircling manner, and wherein the radial dimension a of said clearance corresponds to 0.05-times to 0.15-times the radial dimension b of the joint pin 8 in the region of the second mouth portion 20, which is measured starting from the joint axis x.

A pair of pliers, which is characterized in that the first and/or second mouth portion 20, 22 includes an acute angle with the joint axis x in a cross section.

A pair of pliers, which is characterized in that a length d of the second mouth portion 20 measured in the direction of the joint axis x is greater than a length c of the first mouth portion 22 measured in the direction of the joint axis x.

A pair of pliers, which is characterized in that the second mouth portion 20 is designed for lying radially opposite of a partial region of the second conical portion 21 over part of its axial length d.

A pair of pliers, which is characterized in that the axial length d of the second mouth portion 20 corresponds to 0.1-times to 0.3-times the radial dimension b of the joint pin 8 in the region of the second mouth portion 20, which is measured starting from the joint axis x.

A pair of pliers, which is characterized in that the axial length c of the first mouth portion 22 corresponds to 0.05-times to 0.15-times the radial dimension b of the joint pin 8 in the region of the second mouth portion 20, which is measured starting from the joint axis x.

A pair of pliers, which is characterized in that both mouth portions 20, 22 transform into the same outer side 18 of the assigned pliers leg 2, 3 or the joint pin 8, which extends perpendicular to the joint axis x.

A pair of pliers, which is characterized in that the pair of pliers 1 furthermore has a symmetry axis y, which extends through the joint axis x and on which work regions 9, 10 of the pliers legs 2, 3 can be moved toward one another.

A pair of pliers, which is characterized in that a first ring wall portion 24 is provided on the symmetry axis y and assigned to the work regions 9, 10, wherein the first ring wall portion at least partially surrounds the joint pin 8, and wherein this first ring wall portion has a thickness h that corresponds to between half and one third of the radial dimension b of the joint pin 8 in the region of the second mouth portion 20.

A pair of pliers, which is characterized in that a second ring wall portion 25, which lies opposite of the first ring wall portion 24 in the direction of the symmetry axis y, has a thickness k that approximately corresponds to the diameter of the joint pin 8 in the region of the second mouth portion 20.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristic features of the dependent claims characterize independent inventive enhancements of the prior art, particularly for submitting divisional applications on the basis of these claims.

LIST OF REFERENCE SYMBOLS

1 Pair of pliers
2 Pliers leg
3 Pliers leg
4 Handle leg
5 Handle leg
6 Pliers jaw
7 Pliers jaw
8 Joint pin
9 Work region
10 Work region
11 Joint lug
12 Joint lug
13 Head part
14 Shaft part
15 Rivet depression
16 Bolt face
17 Blind bore
18 Outer side
19 First conical portion
20 Second mouth portion
21 Second conical portion
22 First mouth portion
23 Clearance
24 First ring wall portion
25 Second ring wall portion
a Radial dimension
b Radial dimension
c Length
d Length
e Radial dimension
f Axial dimension
g Axial dimension
h Thickness
k Thickness
x Joint axis
y Symmetry axis

The invention claimed is:

1. A pair of pliers (1) with two pliers legs (2, 3) that are arranged in a crossing manner, wherein a fixed joint with a joint pin (8) is formed, wherein the joint pin (8) has a first conical portion (19), which is assigned to an outer side (18) of a pliers leg (2, 3) and widens toward the outer side (18), and wherein the pliers leg (2, 3) is furthermore assigned a second conical portion (21), which bears on the first conical portion (19) and transforms into a first mouth portion (22) leading into the outer side (18) of the pliers leg (2, 3), wherein the joint pin (8) has a second mouth portion (20) that overlaps the first mouth portion (22) starting from the outer side (18) of the pliers leg (2, 3) and perpendicular to a joint axis (x), wherein the first and the second mouth portion (22, 20) bound a toroidal clearance (23) between one another in a radially encircling manner, and wherein the radial dimension (a) of said clearance corresponds to 0.05-times to 0.15-times the radial dimension (b) of the joint pin (8) in the region of the second mouth portion (20), which is measured starting from the joint axis (x).

2. The pair of pliers according to claim 1, wherein the first and/or second mouth portion (20, 22) includes an acute angle with the joint axis (x) in a cross section.

3. The pair of pliers according to claim 1, wherein a length (d) of the second mouth portion (20) measured in the direction of the joint axis (x) is greater than a length (c) of the first mouth portion (22) measured in the direction of the joint axis (x).

4. The pair of pliers according to claim 1, wherein the second mouth portion (20) is designed for lying radially opposite of a partial region of the second conical portion (21) over part of its axial length (d).

5. The pair of pliers according to claim 1, wherein the axial length (d) of the second mouth portion (20) corresponds to 0.1-times to 0.3-times the radial dimension (b) of the joint pin (8) in the region of the second mouth portion (20), which is measured starting from the joint axis (x) and/or wherein the axial length (c) of the first mouth portion (22) preferably corresponds to 0.05-times to 0.15-times the radial dimension (b) of the joint pin (8) in the region of the second mouth portion (20), which is measured starting from the joint axis (x).

6. The pair of pliers according to claim 1, wherein both mouth portions (20, 22) transform into the same outer side (18) of the assigned pliers leg (2, 3) or the joint pin (8), which extends perpendicular to the joint axis (x).

7. The pair of pliers according to claim 1, wherein the pair of pliers (1) furthermore has a symmetry axis (y), which extends through the joint axis (x) and on which work regions (9, 10) of the pliers legs (2, 3) can be moved toward one another.

8. The pair of pliers according to claim 1, wherein a first ring wall portion (24) is provided on the symmetry axis (y) and assigned to the work regions (9, 10), wherein the first ring wall portion at least partially surrounds the joint pin (8), and wherein this first ring wall portion has a thickness (h) that corresponds to between half and one third of the radial dimension (b) of the joint pin (8) in the region of the second mouth portion (20).

9. The pair of pliers according to claim 1, wherein a second ring wall portion (25), which lies opposite of the first ring wall portion (24) in the direction of the symmetry axis (y), has a thickness (k) that approximately corresponds to the diameter of the joint pin (8) in the region of the second mouth portion (20).

10. A pair of pliers, comprising one or more of the characterizing features of claim 1.

* * * * *